US006672578B1

(12) United States Patent
Martens

(10) Patent No.: US 6,672,578 B1
(45) Date of Patent: Jan. 6, 2004

(54) VISE JAW WITH WORK PIECE SUPPORT SURFACE

(76) Inventor: Mike R. Martens, 7543 Hardy St., Orangevale, CA (US) 95662

( * ) Notice: Subject to any disclaimer, the term of this patent is extended or adjusted under 35 U.S.C. 154(b) by 0 days.

(21) Appl. No.: 10/244,118

(22) Filed: Sep. 13, 2002

(51) Int. Cl.[7] ..... B25B 1/24
(52) U.S. Cl. ..... 269/282; 269/261; 269/43
(58) Field of Search ..... 269/271–282, 269/261, 43

(56) References Cited

U.S. PATENT DOCUMENTS

| | | | | |
|---|---|---|---|---|
| 3,463,479 A | * | 8/1969 | Hennessey | 269/271 |
| 4,383,682 A | | 5/1983 | Feinberg | |
| 4,706,949 A | | 11/1987 | Dossey et al. | |
| 4,863,151 A | | 9/1989 | Justesen | |
| 4,953,840 A | | 9/1990 | Nishimura | |
| 5,150,888 A | | 9/1992 | Durfee | |
| 5,172,895 A | | 12/1992 | Klimach | |
| 5,419,540 A | | 5/1995 | Teafatiller | |
| 5,501,440 A | | 3/1996 | Blise | |
| 5,799,933 A | * | 9/1998 | Yang | 269/261 |
| 6,170,813 B1 | | 1/2001 | Bowers | |
| 6,361,035 B1 | | 3/2002 | Collins | |

* cited by examiner

*Primary Examiner*—Lee D. Wilson
(74) *Attorney, Agent, or Firm*—Heisler & Associates

(57) ABSTRACT

A jaw is provided for a vise which includes a sloping surface for supporting a work piece at a particular angle. The jaw includes a primary mass and a secondary mass which are either formed together as a single unitary mass or formed separately and coupleable together. The primary mass includes a front surface which extends vertically and acts as a surface to hold the work piece within the vise. The secondary mass includes at least one sloping surface which is oriented perpendicular to the front surface of the primary mass. The sloping surface has an angle matching that desired for the work piece. A set of different jaws are provided with each jaw having a secondary mass with a sloping surface of a different angle. The work piece has a surface thereof resting against the sloping surface of the secondary mass of the jaw so that the work piece is held at the desired angle within the vise.

23 Claims, 5 Drawing Sheets

VISE JAW WITH WORK PIECE SUPPORT SURFACE

FIELD OF THE INVENTION

The following invention relates to vises for holding a work piece when the work piece is to be milled, drilled or otherwise machined. More particularly, this invention relates to jaws attachable to fixed and/or sliding plates of the vise; the jaws particularly configured to hold the work piece in an orientation other than a standard orientation resting horizontally within the vise.

BACKGROUND OF THE INVENTION

When a work piece is to be machined, such as by milling or drilling, the work piece must be held securely. Vises are provided to hold the work piece during such machining. While vises come in a variety of different configurations, they generally have the basic configuration including a base which can bolt down to a support surface and with plates which move relative to each other. These plates typically include a fixed plate secured to the base without motion and a sliding plate which moves relative to the base toward and away from the fixed plate. These plates typically include jaws which act as bearing surfaces for the plates with the jaws coming into direct contact with the work piece held within the vise.

For many machining operations, particular angles are required between the work piece and the milling tool so that the work piece can be formed as desired. Modern work piece machining equipment can be rotated so that the cutting tool can have the angle desired relative to the work piece. The work piece can thus merely rest with a lower surface of the work piece oriented horizontally against the base of the vise between the two plates. In some circumstances, however, it is desirable that the cutting tool of the machine remain in a standard vertical or horizontal orientation and to have the work piece angled within the vise so that the desired relative angle between the work piece and the cutting tool is provided.

Numerous prior art vises and vise attachments are known which allow angles of the vise to be adjusted so that a work piece can be held at various different angles within the vise. While such adjustable multi-angle vises do hold the work piece at various different angles, other than merely horizontally resting within the vise, these devices must be carefully set up at the desired angle, checked to make sure that they are in fact oriented as desired, and frequently monitored to make- sure that they are maintaining the desired angle. Many work piece machining operations are repetitive in nature where the machining equipment is initially set up and then a machining routine is run repeatedly for multiple different work pieces to provide each of the work pieces with the same contour. In such a common utilization of the machining equipment, an adjustable angle vise is not particularly advantageous. Rather, the potential for the vise coming out of angular adjustment increases the work of the operator in checking to make sure that the vise is still operating properly. Otherwise, the potential exists for large volumes of work pieces to be improperly machined before detection of the misadjustment of the vise out of position.

Accordingly, a need exists for a vise which can hold a work piece at angles other than horizontal and which can reliably maintain its angled support for the work piece.

SUMMARY OF THE INVENTION

This invention provides a vise jaw which has a supporting surface which is sloped to hold surfaces of the work piece at angles other than horizontal. The jaw is attachable to a fixed plate or sliding plate of the vise, such as through attachment bolts which thread into threaded bores in the vise. The jaw includes a primary mass and a secondary mass adjacent the primary mass. The primary mass has a rear surface adapted to be placed adjacent the fixed plate or the sliding plate of the vise. The front surface of the primary mass opposite the rear surface faces the opposite plate of the vise.

The secondary mass is adjacent the front surface of the primary mass. The secondary mass can either be formed with the primary mass so that a single unitary mass is provided, or the secondary mass can be a separate mass of material adapted to be removably attached to the primary mass. The secondary mass includes at least one sloping surface which extends perpendicularly away from the front surface of the primary mass. The sloping surface is angled so that it includes a lower end below an upper end. The angle of the sloping surface is fixed, but can have any conceivable desired angle.

Preferably, a set of jaws are provided with the angle of the sloping surface different for each jaw in the set. A user would thus select the jaw having the sloping surface angle desired and then utilize that jaw. No risk is thus taken of the sloping surface pivoting out of proper angular orientation for support of the work piece.

As an alternative to the sloping surface of the secondary mass, the jaw can be provided with a series of pin holes with associated pins to extend out of the pin holes. The pin holes are provided in two rows including an upper row of pin holes and a lower row of pin holes. At least one pin is placed in one of the upper pin holes and at least one pin is placed in one of the lower pin holes. An angle between the pin in the upper pin hole and the pin in the lower pin hole defines an angle of slope which the work piece takes on when the work piece is oriented so that it abuts both of the pins simultaneously.

OBJECTS OF THE INVENTION

Accordingly, a primary object of the present invention is to provide a vise jaw which can support a work piece with surfaces of the work piece oriented in a non-horizontal orientation at a desired angle.

Another object of the present invention is to provide a vise jaw which both holds the work piece still and maintains an orientation of the work piece within the vise.

Another object of the present invention is to provide a vise jaw which has a sloping surface of fixed angle so that no risk of improper adjustment of the vise jaw or a slippage of the vise jaw is presented.

Another object of the present invention is to provide a set of vise jaws with each vise jaw having a different sloping surface with a different angle, so that one of the vise jaws can be selected having a desired angle for the work piece.

Another object of the present invention is to provide a vise jaw which both holds the work piece from motion horizontally but also prevents the work piece from moving vertically downward due to forces of a machining tool cutting on the work piece.

Other further objects of the present invention will become apparent from a careful reading of the included drawing figures, the claims and detailed description of the invention.

DESCRIPTION OF THE PREFERRED EMBODIMENT

Figure 1:
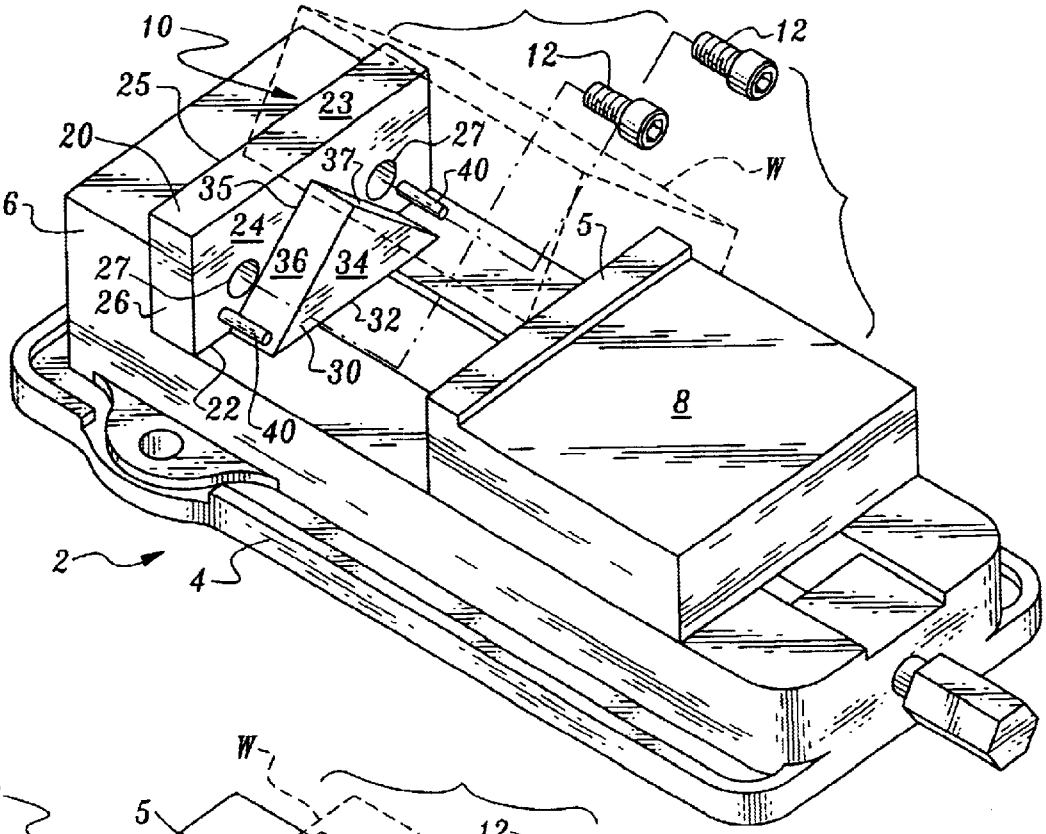
FIG. 1 is a perspective view of a vise jaw according to a preferred embodiment of this invention in place adjacent a fixed plate of the vise and with attachment bolts exploded out of the vise jaw, and with a work piece shown in phantom adjacent the jaw.

Referring to the drawings, wherein like reference numerals represent like parts throughout the various drawing figures, reference numeral 10 (FIG. 1) is directed to a jaw for a vise according to a preferred embodiment of this invention. The jaw 10 includes at least one sloping surface, such as the first slope 36 and second slope 37, to allow a work piece W to rest upon the sloping surface when held by the vise 2. In this way, a work piece W can be oriented with a surface thereof at an angle other than horizontal when such an orientation is beneficial for a machining operation.

Figure 2:
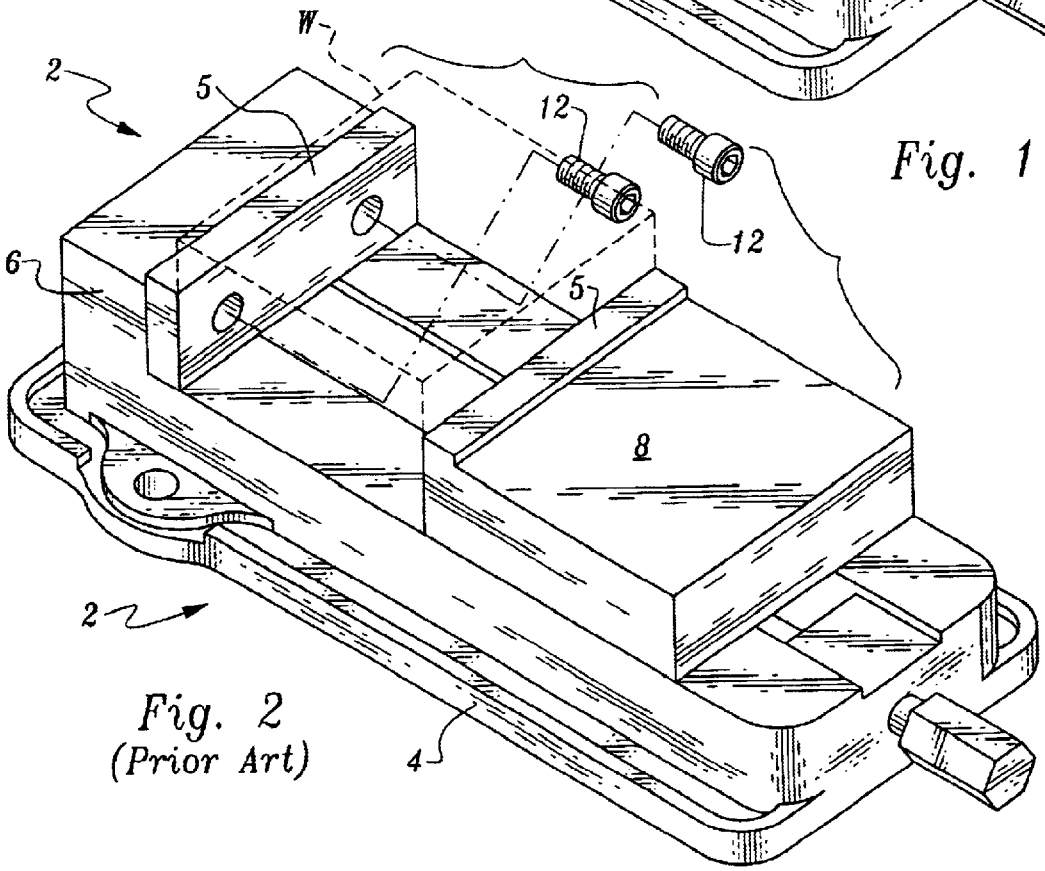
Fig. 2 (Prior Art)
FIG. 2 is a perspective view of a prior art vise and prior art vise jaw.
Figure 3:
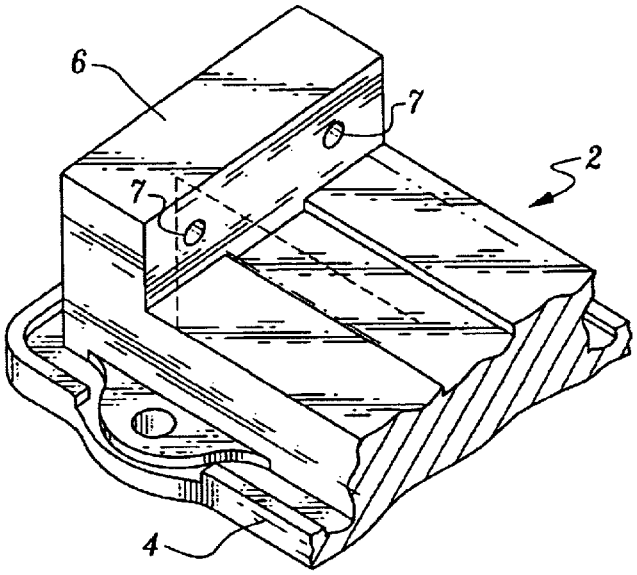
Fig. 3 (Prior Art)
FIG. 3 is a perspective view of a portion of that which is shown in FIG. 2 revealing how threaded bores are provided in the fixed plate of the prior art vise.

With particular reference to FIGS. 2 and 3, details of a standard prior art vise 2 into which the vise jaw 10 of the preferred embodiment of this invention, or other vise jaws according to this invention, can be utilized. The vise 2 includes a base 4 which is adapted to be securely mounted to an underlying surface. The machining tool, such as a milling machine, drill press, or other machining tool is held securely relative to the vise 2 so that the work piece W held within with vise 2 does not move relative to the machining device.

A fixed plate 6 and a sliding plate 8 extend up from the base 4. The fixed plate 6 is secured to the base 4 without motion. The sliding plate 8 is slidably supported upon the base 4. The sliding plate 8 includes appropriate mechanisms to allow the sliding plate 8 to be advanced toward the fixed plate 6 and away from the fixed plate 6. Typically, jaws 5 are attached to each of the plates 6, 8. The jaws 5 include holes therein which align with threaded bores 7 (FIG. 3). Attachment bolts 12 can be utilized to secure the jaw 5 to the plate 6, 8 by utilizing the attachment bolts 12 passing through holes in the jaw 5 and threading the attachment bolts 12 into the threaded bores 7 in the plates 6, 8.

The vise 2 shown in FIGS. 1–3, 5 and 12 is a standard vise 2 representative of vises used to hold work pieces W to be machined. However, vises come in a variety of different configurations. For instance, some vises are configured to have both opposing plates move relative to the base. Such vises can be used according to this invention with one of the plates referred to as the fixed plate for convenience and to establish a frame of reference.

With particular reference to FIG. 1, basic features of the jaw 10 of the preferred embodiment are described. The jaw 10 includes a primary mass 20 of a rigid material having a rear surface abutting the plate 6 of the vise 2. A front surface 24 opposite the rear surface 25 faces the sliding plate 8. Bolt holes 27 extend through the primary mass 20 and receive attachment bolts 12 to secure the primary mass 20 to the fixed plate 6 of the vise 2.

A secondary mass 30 extends from the front surface 24 of the primary mass 20. In this embodiment, the secondary mass 30 is formed along with the primary mass 20 as a single unitary mass of material. The secondary mass 30 includes a first slope 36 and second slope 37. Each of these sloping surfaces include a lower end and an upper end.

The sloping surfaces are oriented perpendicular to the front surface 24 of the primary mass 20. The sloping surfaces are oriented at a slope which is desired for orientation of a lower surface of the work piece W or other surface of the work piece W when the work piece W is held within the vise 2. Hence, the work piece W can merely rest against the sloping surface having the desired angle and the sliding plate 8 closed toward the fixed plate 6 until the work piece W is trapped between the front surface 24 of the primary mass 20 and the sliding plate 8 (or an appropriate jaw coupled to the sliding plate 8), with the work piece W resting upon the sloping surface so that the work piece W has the desired orientation.

Work piece stops, also called slide stops, such as the stop pins 40 are provided near the lower ends of the sloping surfaces. The stop pins 40 hold the work piece W so that the work piece W does not slide down the sloping surfaces and out of a desired position. The jaw 10 of this preferred embodiment is only typically one of many different jaws such as the jaws 50, 110, 210, 310, 410, 510, 610, 710, 810, 910 which are provided with different angles and different configurations to hold the work piece W at a desired angle. A set of such jaws would typically be provided with only the jaw having a desired angle selected for use during any given setup of the vise 2 for performing the desired machining operation upon the work piece W.

More specifically, and with continuing reference to FIG. 1, details of the jaw 10 of the preferred embodiment are described. The jaw 10 preferably includes a single unitary mass of material including both the primary mass 20 and the secondary mass 30. In certain embodiments of this invention described below, the primary mass 20 and secondary mass 30 are separate structures removably attachable together.

The primary mass 20 portion of the jaw 10 is preferably orthorhombic in form having a planar bottom surface 22 parallel with a planar top surface 23. A planar front surface 24 is provided parallel and spaced from a planar rear surface 25. Two side surfaces 26 are provided parallel and spaced from each other.

The width of the primary mass 20 between the side surfaces 26 is preferably similar to a width of a fixed plate 6 and sliding plate 8 of the vise 2. The height of the primary mass 20 between the bottom surface 22 and top surface 23 is preferably similar to but greater than a height of the fixed plate 6 and sliding plate 8 up from the base 4. The thickness of the primary mass 20 between the front surface 24 and rear surface 25 is preferably similar to that of prior art vise jaws 5 (FIG. 2).

The front surface 24 of the primary mass 20 is parallel with the surface of the sliding plate 8 facing the fixed plate 6. Thus, the front surface 24 is provided to securely engage one of the surfaces of a work piece W to be held within the vise 2. Bolt holes 27 extend from the front surface 24 through to the rear surface 25. At least one bolt hole 27 is provided with preferably two bolt holes 27 provided having a spacing similar to a spacing between threaded bores 7 (FIG. 3) in the fixed plate 6.

While the jaw 10 of the preferred embodiment is shown attached to the fixed plate 6, the jaw 10 could similarly be attached to the sliding plate 8 and still function according to this invention. It is also conceivable that a pair of identical or mirror image jaws 10 could be provided with one of the jaws 10 attached to the fixed plate 6 and the other of the jaws 10 attached to the sliding plate 8. Typically, however, only a single jaw 10 is needed adjacent one of the plates 6, 8 to provide the function of holding the work piece W at the desired angle according to this invention.

While the bolt holes 27 are shown extending horizontally toward the fixed plate 6, the bolt holes 27 could be oriented vertically. For instance, threaded holes could be formed vertically into the base 4 of the vise 2 and the primary mass 20 and/or the secondary mass 30 could have vertical bolt holes alignable over the base 4 threaded holes for attachment of the jaws 10 to the vise 2.

The primary mass 20 and secondary mass 30 are preferably formed of aluminum, but could alternatively be formed from other material suitable for use in the construction of vise jaws. If desired, a front surface 24 of the primary mass 20 can be roughened to enhance a coefficient of friction exhibited by the front surface 24.

The secondary mass 30 is formed along with the primary mass 20 according to the preferred embodiment of the jaw 10. Alternatively, the secondary mass 30 can be formed as a separate mass of material removably attachable or permanently attached to the primary mass 20. The secondary mass 30 is formed of a rigid material and includes a base 32 which is planar and preferably coextensive with the bottom 22 of the primary mass 20. A planar face 34 is provided parallel with a planar back 35. The back 35 abuts the front 24 of the primary mass 20. The face 34 faces the sliding plate 8 of the vise 2.

Upwardly facing surfaces of the secondary mass 30 opposite the base 32 are provided as sloping surfaces. Specifically, according to the jaw 10 of the preferred embodiment a first slope 36 and second slope 37 are provided which extend up toward each other where they join together at a midpoint of the secondary mass 30.

Each slope 36, 37 includes a lower end and an upper end with the upper end elevated above the lower end. Hence, each slope 36, 37 exhibits an angle diverging away from a horizontal angle. The slopes 36, 37 are preferably each oriented perpendicular to the front 24 of the primary mass 20. Hence, a work piece W which is orthorhombic in form, having mutually perpendicular sets of sides, can be oriented adjacent the jaw 10 with one of the surfaces of the work piece W adjacent the front 24 of the primary mass 20 and an adjacent surface of the work piece W adjacent one of the slopes 36, 37 of the secondary mass 30.

As shown in FIG. 1, the work piece W is shown with a lower surface of the work piece W adjacent the second slope 37. The work piece W could be rotated 90° in different directions and still maintain secure contact adjacent the front 24 of the primary mass 20 and the sloping surfaces of the secondary mass 30. While the work piece W of orthorhombic form is shown, any work piece W having at least two surfaces which are perpendicular to each other could be utilized and benefit from the orientation of the sloping surfaces of the secondary mass 30 relative to the front 24 of the primary mass 20.

Work piece stops are provided, preferably in the form of stop pins 40 to keep the work piece W from sliding along the first slope 36 or second slope 37, especially when pressure such as that applied by a cutting tool, is exerted downward upon the work piece W. The stop pins 40 according to the preferred embodiment preferably extend from the front 24 of the primary mass 20 near the lower ends of both the first slope 36 and the second slope 37. The stop pins 40 are oriented with surfaces thereof perpendicular to the front 24. Alternatively, the stop pins 40 can extend perpendicularly up from the first slope 36 and/or second slope 37 (i.e. FIGS. 8 and 9). While the slide stops are shown in the preferred embodiment as stop pins 40, other structures can be provided to resist sliding of the work piece W down the sloping surfaces of the secondary mass 30.

Figure 4:
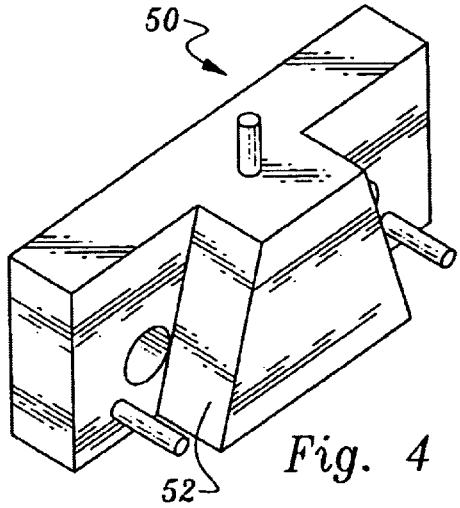
FIG. 4 is a perspective view of a steep slope jaw providing an alternative to the preferred embodiment of this invention.

With particular reference to FIG. 4, details of a second alternative embodiment of this invention is disclosed. While this invention is described herein through the particular description of numerous different embodiments, these different embodiments could either exist separately or be utilized together as a kit including many or all of the different embodiments particularly depicted herein. In addition, the angular measurements of the different sloping surfaces of the various different jaws of the embodiments of this invention could each be modified to have angular orientations of various measures. Preferably, sets of jaws would in fact be provided with each jaw in the set having a slightly different angular measurement or different configuration, so that a user can select from the set a jaw having the slope and other characteristics desired.

The steep slope jaw 50 of FIG. 4 is similar to the jaw 10 of the preferred embodiment except that a steep surface 52 is provided as the sloping surface of the secondary mass. The steepness exhibited dictates that the sloping surfaces never come together and clearance away from the bolt holes dictate somewhat the position of the stop pins. The steep slope jaw 50 of FIG. 4 thus illustrates an alternative embodiment which would typically be provided in a set along with the jaw 10 of the preferred embodiment (FIG. 1) and numerous other jaws of similar configuration but with different angular measurements for the sloping surfaces thereof.

Figure 5:
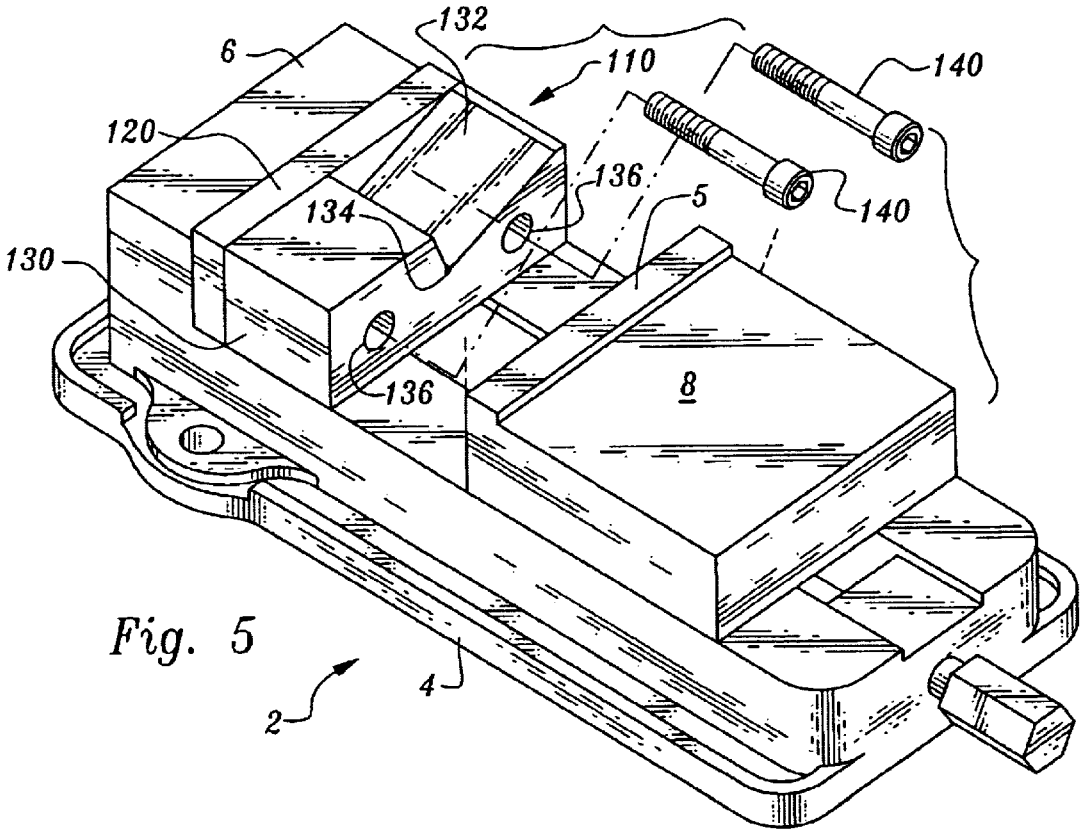
FIG. 5 is a perspective view of a prior art vise fitted with a composite jaw according to a third embodiment of this invention.

With particular reference to FIG. 5, details of a third embodiment of this invention are described. The third embodiment of this invention is in the form of a composite jaw 110. The composite jaw 110 is conceptually similar to the jaw 10 of the preferred embodiment, except that the primary mass 120 and secondary mass 130 are not formed together as a single unitary mass. Rather, the primary mass 20 and secondary mass 130 are in fact two separate structures which are removably attachable together. Long bolts 140 are provided which pass through bolt holes 136 in, the secondary mass 130 and the primary mass 120.

For simplicity, the primary mass 120 and secondary mass 130 are not directly attached together, but rather the long bolts 140 pass through the secondary mass 130 and through the primary mass 120 and then are threaded into the fixed plate 6 of the vise 2. Once the long bolts 140 are tightly secured to the fixed plate 6, the primary mass 120 and secondary mass 130 are securely held together with the primary mass 120 sandwiched between the secondary mass 130 and the fixed plate 6.

The composite jaw 110 uniquely includes a valley 132 where the sloping surfaces slope downward toward each other and upward away from each other. Such an arrangement is the reverse of that depicted in the jaw 10 and jaw 50 of FIGS. 1 and 4. The valley 132 provides a single region into which a work piece can be supported. With this composite jaw 110, the valley 132 exhibits two sloping surfaces of different angles. In fact, the sloping surfaces of the secondary mass 130 could be any of a variety of different angles and would in fact typically be provided as one secondary mass 130 of a set, with each secondary mass in the set having a slightly different angle for the sloping surfaces thereof.

With this composite jaw 110, a single primary mass 120 would typically be provided with multiple secondary masses 130 having different angular configurations. The valley 132 advantageously acts both to properly orient the lower surface of the work piece with one of the side surfaces of the work piece and also prevents the work piece W from sliding when downward forces are exerted on the work piece.

To ensure that a sharp corner of the work piece can rest entirely down to a bottom of the valley 132, a clearance notch 134 is preferably provided to provide relief for any such sharp corner of the work piece. The composite jaw 110 depicts an alternative embodiment to that of the jaw 10 where the primary mass 20 and secondary mass 30 are formed together. The particular orientations of the surfaces of the composite jaw 110 and the jaw 10 of the preferred embodiment could be shared. Hence, any embodiments included herein which are depicted in the form of composite jaws could similarly be provided with a jaw formed of a unitary mass of material.

Figure 6:
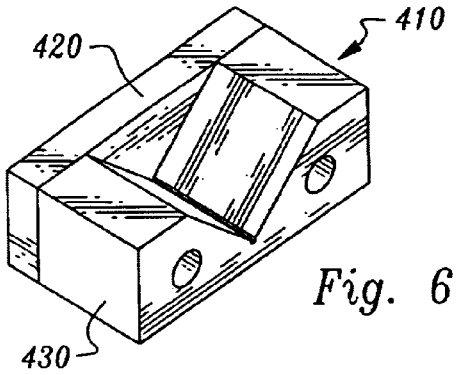
FIG. 6 is a perspective view of a fourth embodiment jaw of this invention.

With particular reference to FIG. 6, a fourth embodiment jaw 410 is disclosed. The jaw 410 includes a primary mass 420 similar to the primary mass 120 of FIG. 5. A secondary mass 430 is provided which is similar to the secondary mass 130 of FIG. 5. However, the secondary mass 430 depicted in FIG. 6 has sloping surfaces which are similar in angle to each other and measure approximately 45°. With this fourth embodiment of FIG. 6, a work piece having perpendicular sides can rest diagonally upon the secondary mass 430.

Figure 7:
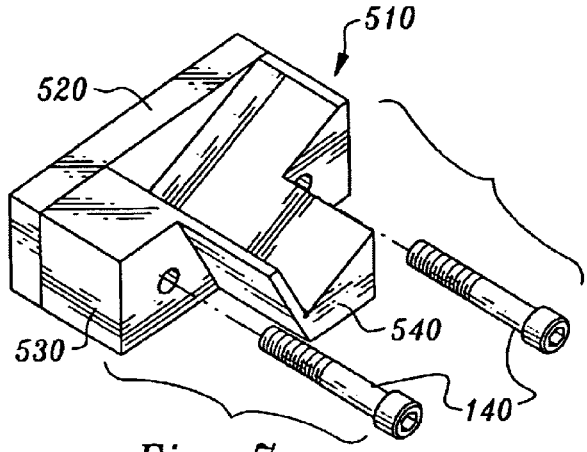
FIG. 7 is a perspective view of a fifth embodiment jaw of this invention with long bolts exploded out of bolt holes to illustrate how the jaw of this embodiment attaches to the vise.

FIG. 7 depicts a fifth alternative embodiment jaw 510. The jaw 510 includes a primary mass 520 similar to the primary mass 120 of FIG. 5. The secondary mass 530 not only includes unique sloping surfaces to depict another possible angle for the sloping surfaces thereof, but additionally includes an extension 540. The extension 540 provides a greater amount of surface area for the sloping surfaces, while still maintaining a similar thickness through which long bolts 140 must travel to secure the secondary mass 530 and primary mass 520 to the fixed plate 6 (FIG. 3). The extension 540 is particularly advantageous where significant downward forces are to be applied by a milling machine or other machining tool upon the work piece, and it is desirable to have additional support to prevent the work piece from deflecting downwards during machining.

Figure 8:
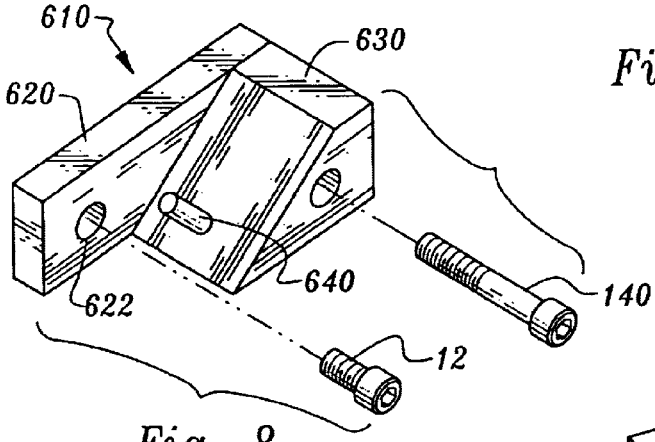
FIG. 8 is a perspective view of a sixth embodiment jaw of this invention with a long bolt and a short bolt exploded out of bolt holes in the primary mass and the secondary mass of this embodiment of the jaw.

FIG. 8 depicts a sixth alternative embodiment jaw 610. The jaw 610 includes a primary mass 620 similar to the primary mass 120 of FIG. 5. FIG. 6 particularly shows the primary, mass hole 622 which is blocked in many other figures. The secondary mass 630 is shortened in width and only covers a portion of the primary mass 620. With this jaw 610, a short attachment bolt 12 and a long attachment bolt 140 are simultaneously utilized to secure the primary mass 620 and the secondary mass 630 to the fixed plate 6 (FIG. 3). The sloping surface of the secondary mass 630 preferably includes a post 640 extending perpendicularly upward therefrom to act as a slide stop.

Figure 9:
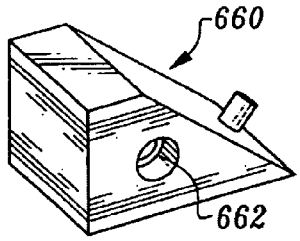
FIG. 9 is a perspective view of an alternative secondary mass according to the sixth embodiment of this invention.

FIG. 9 depicts a left hand secondary mass 660 similar to the secondary mass 630, but reversed for use in situations where such a reversal is advantageous to hold the work piece as desired. FIG. 9 particularly depicts the step 662 within the bolt hole of this left version secondary mass 660. In fact, each of the secondary masses of the various different embodiments of this invention preferably include such a step so the head of the attachment bolt 12 or long bolt 140 can abut the step and hold the secondary mass and primary mass adjacent the fixed plate 6 having the threaded bores 7 into which the bolts 12, 140 are threaded (FIG. 3). This step is preferably sufficiently deep so that the head of the bolt can be entirely nested within the bolt hole and the face of the secondary mass is left without obstruction, should the face of the secondary mass be utilized in any way to secure a work piece within the vise 2.

Figure 10:
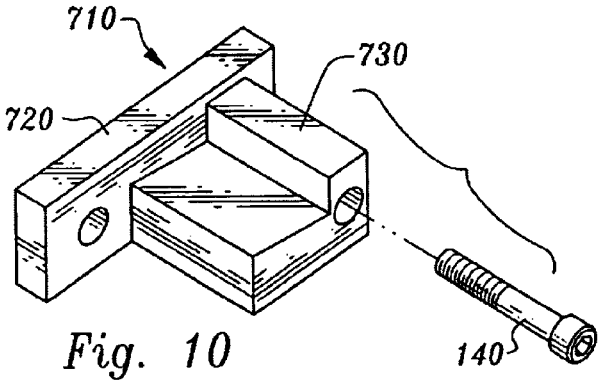
FIG. 10 is a perspective view of a seventh embodiment jaw of this invention with a long bolt exploded out of the jaw.

FIG. 10 depicts a seventh alternative embodiment jaw 710. In this embodiment a pair of sloping surfaces come together in a valley formed in a secondary surface 730 which is held to the primary surface with a single long bolt. As with other embodiments, a variety of different angles would be provided for the sloping surfaces in a set with a single primary mass 720, so that the vise can be set up to hold the work piece at the desired angle.

Figure 11:
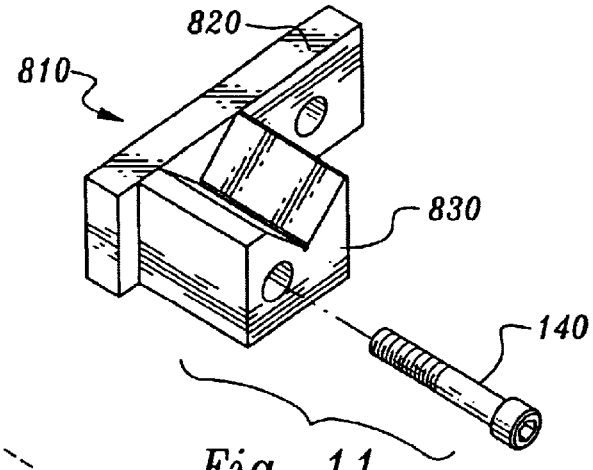
FIG. 11 is a perspective view of an eighth embodiment jaw of this invention with a long bolt exploded out of the jaw.
Figure 12:
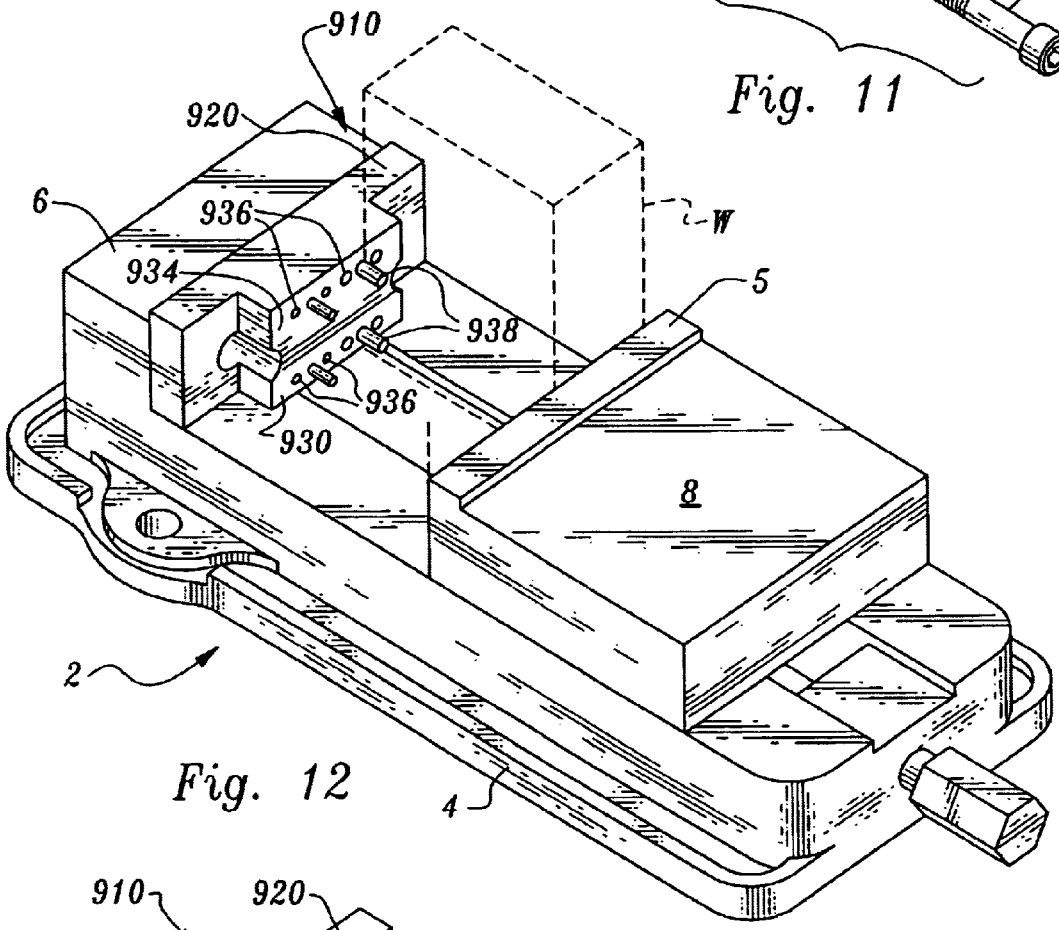
FIG. 12 is a perspective view of a ninth embodiment jaw of this invention attached within the prior art vise and with a work piece shown in broken lines held by the jaw and vise.
Figure 13:
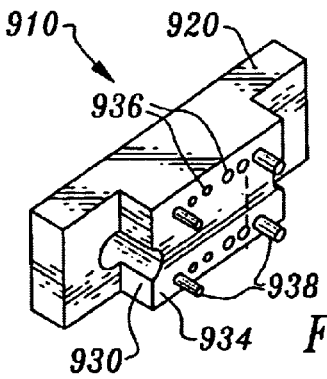
FIG. 13 is a perspective view of the jaw alone, according to this ninth embodiment.

FIG. 11 depicts an eighth alternative embodiment jaw 810. The eighth alternative jaw 810 illustrates particularly how sloping surfaces of different angles can be accommodated in the secondary mass 830 attached to the primary mass 820. The jaw 810 similarly illustrates how such a secondary mass 830 can attach to either a left or a right end of the primary mass 820, 720 and still function effectively according to this invention. It is also conceivable that multiple different secondary masses could be simultaneously attached to a single primary mass so that various different angled sloping surfaces would be simultaneously provided when such a set up arrangement is desired. With particular reference to FIGS. 12 and 13, a ninth alternative embodiment jaw 910 is described. The jaw 910 is in the form of a single jaw which can be adjusted to accommodate different angles in a semi-permanent fashion. Particularly, the jaw 910 includes a primary mass 920 and a secondary mass 930 which are preferably formed together as a unitary mass of material. In this embodiment, the secondary mass 930 of the jaw 910 includes a face 934 which acts to abut the work piece W and hold the work piece W within the vise 2.

The face 934 is preferably planar and oriented vertically facing the sliding plate 8 of the vise 2. The face 934 includes a series of pin holes 936 therein. Preferably, the pin holes 936 are oriented in two horizontal rows including a lower row of pin holes 936 and an upper row of pin holes 936.

Alternatively, the rows of pin holes 936 could be along an arcuate line or some other irregular arrangement. A plurality of pins 938 are provided, sized to fit in the holes 936. Preferably, at least two pins 938 are provided with one pin 938 located in one of the pin holes 936 in the lower row and one of the pins 938 located within one of the pin holes 936 in the upper row.

The pins 938 are located so that they are horizontally offset from each other by an amount which causes a slope to exist between the pins 938. Specifically, when a work piece W is oriented so that a surface of the work piece W abuts both of the pins 938 simultaneously when one of the pins is in a pin hole 936 in the lower row of pin holes 936 and one of the pins 938 is located in one of the pin holes 936 in the upper row of pin holes 936, the work piece W has this surface abutting the pins 938 oriented at a sloping angle. The pin holes 936 would be precisely located so that particular combinations of pins 938 and particular pin holes 936 would cause a work piece W to attain different slopes based on which pin holes 936 have the pins 938 located therein.

The pins 938 are removably attachable within the pin holes 936. A work piece W can thus be oriented at a variety of different angles merely by locating the pins 938 and appropriate pin holes 936 and then causing the work piece W to rest against both of the pins 938 simultaneously. This jaw 910 can be utilized not only to hold the work piece W at a non-vertical angle, but also to align the work piece W at a precisely vertical angle, should such an arrangement be desired (as particularly shown in FIG. 12).

In use and operation and with particular reference to FIGS. 1–3, details of the operation of the jaw 10 according to the preferred embodiment are described. Initially, a user determines what angle the work piece W should be aligned with for proper machining of the work piece W. A user then selects a jaw, such as the jaw 10, having a sloping surface which matches the slope at which the work piece W is to be oriented. The jaw 10 is then located adjacent the fixed plate 6 and the attachment bolts 12 are utilized to secure the jaw 10 to the fixed plate 6. The work piece W is then oriented with a surface of the work piece W abutting the sloping surface, such as the second slope 37, and with an end surface of the work piece W abutting the front 24 of the primary mass 20 of the jaw 10.

The sliding plate 8 of the vise 2 is then slid along the base 4 until the work piece W is trapped within the vise 2. The work piece W is thus held securely in place for the appropriate machining operation to take place. When the machining operation has been completed, the vise 2 releases the work piece W by moving of the sliding plate 8 and a new work piece W can be placed into the vise 2 to repeat the machining operation. Because the vise jaw 10 itself has only the one angle provided by the sloping surface, no risk is presented that the vise 2 can come out of alignment in any way and cause the work piece W to become accidentally misaligned. Hence, the need to recheck the setup of the vise 2 is reduced or eliminated. When a work piece W is to be machined having an orientation different from a previous work piece W, a new jaw is selected and the old jaw 10 is removed by removal of the attachment bolts 12 and replacement of the previous jaw with the new jaw and attachment with the attachment bolts 12 back to the fixed plate 6.

According to the third embodiment of FIG. 5 including the composite jaw 110, the operation of the invention would proceed similarly to that described above. However, a user would not select the entire jaw to utilize, but rather would select a secondary mass 130 having the desired angle and place that secondary mass 130 adjacent the primary mass 120 before utilizing the long bolts 140 to secure each of the masses 120, 130 to the fixed plate 6.

With particular reference to FIGS. 12 and 13, details of the operation of the ninth alternative embodiment jaw 910 are described. With this embodiment, the user first determines the angle at which the work piece W is to be oriented. The user then identifies pinholes 936 which must have pins 938 therein so that the work piece W will have the proper angle when abutting both of the pins 938. The pins 938 are then placed in the appropriate pin holes 936 and the jaw 910 is attached to the fixed plate 6 of the vise 2, as described in detail above. The work piece W is then oriented with one surface of the work piece W abutting both of the pins 938 and with an adjacent surface of the work piece W abutting the face 934 of the jaw 910. The vise 2 is then closed to secure the work piece W in the desired position. As with the jaws of the preferred embodiment and other embodiments, because the pins do not slide or are otherwise adjusted, but rather are either included or removed from various different pin holes 938, the risk of the vise 2 and the associated jaw 910 coming out of proper alignment is eliminated so that the jaw 910 can repeatedly hold work pieces W in a proper orientation for machining thereof.

Figure 14:
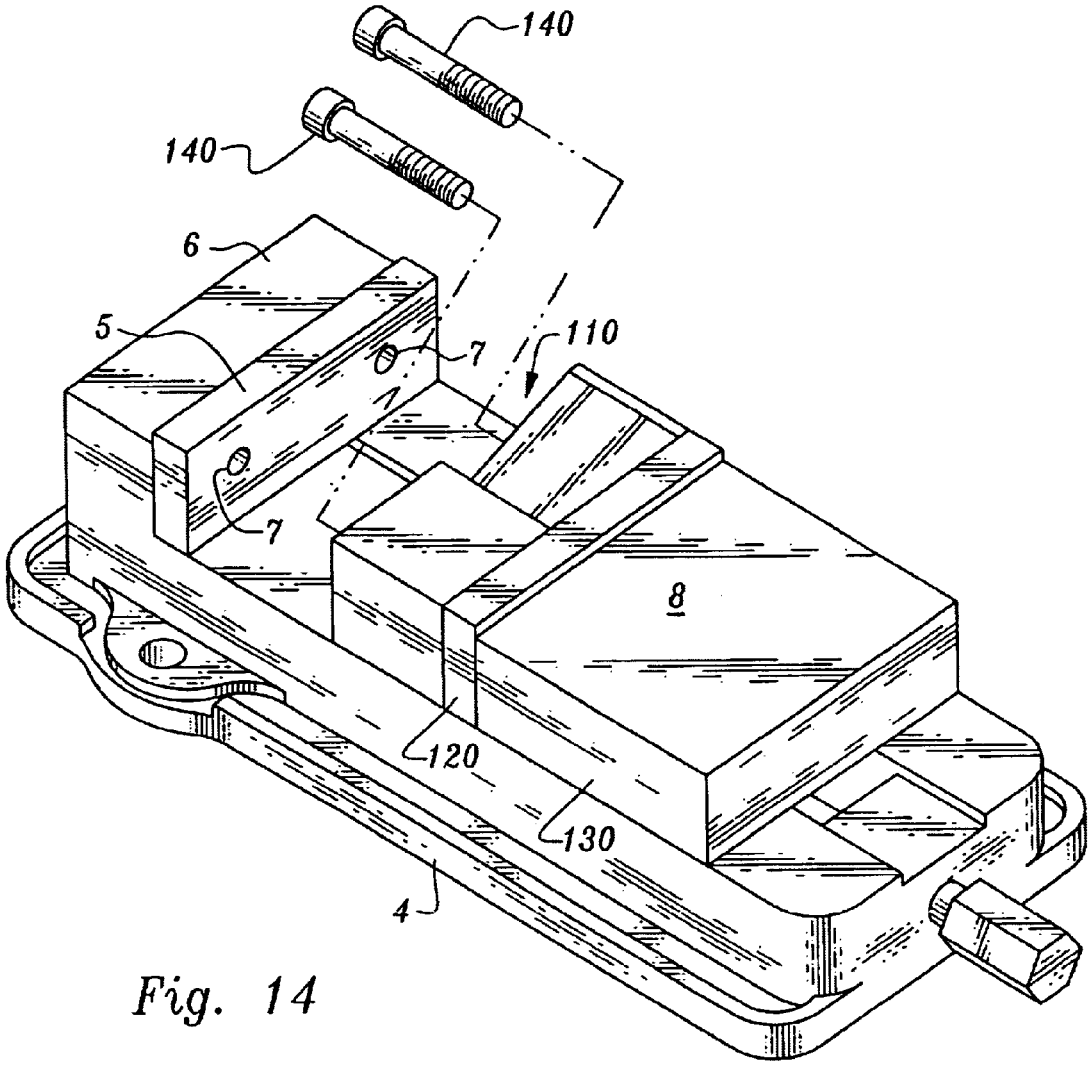
FIG. 14 is a perspective view of that which is shown in FIG. 5 but with the jaw of one embodiment of this invention attached to a sliding plate of the vise rather than to a fixed plate of the vise.

FIG. 14 is provided, which is similar to FIG. 5 illustrating the composite jaw 110 of this invention. FIG. 14 differs from FIG. 5 in that the composite jaw 110 has been relocated so that it is attached to the sliding plate 8 rather than to the fixed plate 6. Otherwise, the composite jaw 110 shown in FIG. 14 is merely a mirror image of the composite jaw 110 shown in FIG. 5. FIG. 14 is provided merely to explicitly illustrate that the vise jaws of this invention can be attached either to the fixed plate 6 or to the sliding plate 8 according to this invention.

This disclosure is provided to reveal a preferred embodiment of the invention and a best mode for practicing the invention. Having thus described the invention in this way, it should be apparent that various different modifications can be made to the preferred embodiment without departing from the scope and spirit of this disclosure. When structures are identified as a means to perform a function, the identification is intended to include all structures which can perform the function specified.

What is claimed is:

1. A jaw for attachment to a vise having a fixed plate and a sliding plate with said sliding plate adapted to move toward and away from said fixed plate, the jaw comprising in combination:

a primary mass of rigid material having a substantially flat front surface;

means to attach said primary mass of said jaw to one of the plates with said front surface of said primary mass facing the plate said jaw is not attached to;

a secondary mass adjacent to said front surface of said primary mass;

said secondary mass including at least one sloping surface, said at least one sloping surface oriented perpendicular to said front surface of said primary mass;

said sloping surface maintaining a fixed orientation relative to said primary mass; and wherein said means to attach said primary mass to said vise includes at least one bolt hole passing substantially horizontally entirely through both said primary mass and said secondary mass, said bolt hole having a size at least as large as a diameter of a bolt adapted to be threaded into one of the plates of the vise, said bolt hole positioned to be aligned with at least one threaded bore in one of the plates of the vise.

2. The jaw of claim 1 wherein said primary mass and said secondary mass are provided as a single unitary mass of material.

3. The jaw of claim 1 wherein said primary mass and said secondary mass are two separate masses of material, said primary mass and said secondary mass each adapted to be removably coupled to each other.

4. The jaw of claim 3 wherein said primary mass and said secondary mass each include at least one bolt hole passing there through, said bolt holes in said primary mass and said secondary mass each sized sufficiently large to receive a bolt there through which is adapted to attach to one of the plates of the vise to secure said primary mass and said secondary mass to one of the plates of the vise.

5. The jaw of claim 4 wherein said bolt hole in said secondary mass includes a step therein defining a transition between a smaller diameter portion of said bolt hole and a larger diameter portion of said bolt hole, said larger diameter portion of said bolt hole sized sufficiently large to receive a head of said bolt therein and said smaller diameter portion of said bolt hole sufficiently small to prevent said head of said bolt from passing there through, said step sufficiently deep within said secondary mass that said head of said bolt can nest entirely within said bolt hole.

6. The jaw of claim 4 wherein at least two bolt holes are provided in said primary mass and at least two bolt holes are provided in said secondary mass, a distance between said two bolt holes in said primary mass and said two bolt holes in said secondary mass being identical, such that the two bolt holes in said primary mass can be aligned with said two bolt holes in said secondary mass.

7. A jaw for attachment to a vise having a fixed plate and a sliding plate with said sliding plate adapted to move toward and away from said fixed plate, the jaw comprising in combination:

a primary mass of rigid material having a substantially flat front surface;

means to attach said primary mass of said jaw to one of the plates with said front surface of said primary mass facing the plate said jaw is not attached to;

a secondary mass adjacent to said front surface of said primary mass;

said secondary mass including at least one sloping surface, said at least one sloping surface oriented perpendicular to said front surface of said primary mass;

said sloping surface maintaining a fixed orientation relative to said primary mass;

wherein said primary mass and said secondary mass are provided as a single unitary mass of material; and wherein a work piece stop is coupled to one of said masses with said work piece stop oriented above a portion of said sloping surface.

8. The jaw of claim 7 wherein said sloping surface includes a lower end below an upper end, said work piece stop located closer to said lower end of said sloping surface than to said upper end of said sloping surface, such that a work piece resting upon said sloping surface is prevented from sliding off of said sloping surface by abutting said work piece stop.

9. The jaw of claim 8 wherein said work piece stop includes at least one pin extending perpendicularly away from said front surface of said primary mass above said lower end of said sloping surface.

10. The jaw of claim 8 wherein said work piece stop includes at least one stop post, said stop post extending perpendicularly up from a portion of said sloping surface closer to said lower end of said sloping surface than to said upper end of said sloping surface.

11. A jaw for attachment to a vise having a fixed plate and a sliding plate with said sliding plate adapted to move toward and away from said fixed plate, the jaw comprising in combination:

a primary mass of rigid material having a substantially flat front surface;

means to attach said primary mass of said jaw to one of the plates with said front surface of said primary mass facing the plate said jaw is not attached to;

a secondary mass adjacent to said front surface of said primary mass;

said secondary mass including at least one sloping surface, said at least one sloping surface oriented perpendicular to said front surface of said primary mass;

said sloping surface maintaining a fixed orientation relative to said primary mass;

wherein said primary mass and said secondary mass are two separate masses of material, said primary mass and said secondary mass each adapted to be removably coupled to each other;

wherein said sloping surface of said secondary mass includes a lower end below an upper end; and wherein a work piece stop is coupled to one of said masses, said work piece stop located closer to said lower end of said sloping surface than to said upper end of said sloping surface, such that a work piece resting upon said sloping surface is prevented from sliding off of said sloping surface by abutting said work piece stop.

12. The jaw of claim 11 wherein said work piece stop includes at least one pin extending perpendicularly away from said front surface of said primary mass above said lower end of said sloping surface.

13. The jaw of claim 11 wherein said work piece stop includes at least one stop post, said stop post extending perpendicularly up from a portion of said sloping surface closer to said lower end of said sloping surface than to said upper end of said sloping surface.

14. A set of vise jaws for supporting a work piece at various different angles, the set of vise jaws comprising in combination:

a primary mass of rigid material having a substantially planar front surface, said primary mass adapted to be coupled to the vise with said front surface oriented to engage a vertically oriented surface of the work piece to be held;

a plurality of secondary masses, each said secondary mass including a back surface adapted to abut said front surface of said primary mass and at least one slope adapted to be oriented perpendicular to said front surface of said primary mass when said back of said secondary mass abuts said primary mass, each said secondary mass having a sloping surface which slopes at a different angle, said secondary masses adapted to be removably attached to said primary mass and to said vise with said sloping surfaces having a lower end below an upper end, such that a work piece resting upon the sloping surface is oriented at an angle matching that of said sloping surface.

15. The vise jaw set of claim 14 wherein each said secondary mass includes at least one bolt hole passing there through and said primary mass includes a bolt hole passing there through, with said bolt holes in said secondary masses and said bolt hole in said primary mass alignable together with said back of said secondary mass adjacent said front surface of said primary mass; and a bolt adapted to removably attach at least one of said secondary masses to said primary mass through said bolt holes in said masses.

16. The vise jaw set of claim 15 wherein at least one of said secondary masses includes a pair of sloping surfaces with lower ends of said sloping surfaces adjacent each other to form a valley in said secondary mass.

17. The vise jaw set of claim 16 wherein said lower ends of said two sloping surfaces are joined together by a notch extending into said secondary mass below both said first slope and said second slope.

18. A set of vise jaws for supporting a work piece at various different angles, the set of vise jaws comprising in combination:

a primary mass of rigid material having a substantially planar front surface, said primary mass adapted to be coupled to the vise with said front surface oriented to engage a vertically oriented surface of the work piece to be held;

a plurality of secondary masses, each said secondary mass including a back surface adapted to abut said front surface of said primary mass and at least one slope adapted to be oriented perpendicular to said front surface of said primary mass when said back of said secondary mass abuts said primary mass, each said secondary mass having a sloping surface which slopes at a different angle, said secondary masses adapted to be removably attached to said primary mass and to said vise with said sloping surfaces having a lower end below an upper end, such that a work piece resting upon the sloping surface is oriented at an angle matching that of said sloping surface;

wherein each said secondary mass includes at least one bolt hole passing there through and said primary mass includes a bolt hole passing there through, with said bolt holes in said secondary masses and said bolt hole in said primary mass alignable together with said back of said secondary mass adjacent said front surface of said primary mass;

a bolt adapted to removably attach at least one of said secondary masses to said primary mass through said bolt holes in said masses; and wherein one of said secondary masses includes a single sloping surface having an upper end and a lower end, said sloping surface including a pin extending perpendicularly up from a portion of said sloping surface closer to said lower end than to said upper end.

19. A method for securely holding a work piece within a vise with the work piece held at an angle such that at least one surface of the work piece is held non-horizontally, the vise having a base with a fixed plate extending up from the base and a sliding plate slidably coupled to the base, with the sliding plate facing the fixed plate and the sliding plate adapted to move toward and away from the fixed plate, the fixed plate having a pair of threaded bores extending into a surface of the fixed plate facing the sliding plate, the method including the steps of:

providing a jaw with a primary mass having a rear surface adapted to abut one of said plates of said vise and a front surface opposite said rear surface, said front surface facing the plate of the vise which the primary mass is not abutting;

configuring the jaw to include a secondary mass adjacent the front surface of the primary mass, the secondary mass including at least one sloping surface oriented perpendicular to the front surface of the primary mass, the sloping surface having a lower end below an upper end, and to include at least one bolt hole passing substantially horizontally entirely through both the primary mass and the secondary mass, the bolt hole having a size at least as large as a diameter of a bolt adapted to be threaded into one of the plates of the vise, the bolt hole positioned to be alienable with one of the threaded bores of the fixed plate;

resting a lower surface of the work piece adjacent the slope of the secondary mass; and closing the vise until the front surface of the primary mass abuts the work piece.

20. The method of claim 19 including the further step of forming the primary mass and the secondary mass from a single unitary mass of material and selecting the sloping surface of the secondary mass to have an angle corresponding with an angle desired for orientation of one of the surfaces of the work piece.

21. The method of claim 19 including the further steps of adapting the secondary mass and the primary mass to be removably attachable to each other;

selecting the secondary mass to have a sloping surface having an angle matching a desired angle for a surface of the work piece;

attaching the secondary mass selected in said selecting step to the primary mass; and closing the plates of the vise together until the front surface of the primary mass abuts the work piece.

22. A method for securely holding a work piece within a vise with the work piece held at an angle such that at least one surface of the work piece is held non-horizontally, the vise having a base with a fixed plate extending up from the base and a sliding plate slidably coupled to the base, with the sliding plate facing the fixed plate and the sliding plate adapted to move toward and away from the fixed plate, the fixed plate having a pair of threaded bores extending into a surface of the fixed plate facing the sliding plate, the method including the steps of:

providing a jaw with a primary mass having a rear surface adapted to abut one of said plates of said vise and a front surface opposite said rear surface, said front surface facing the plate of the vise which the primary mass is not abutting;

configuring the jaw to include a secondary mass adjacent the front surface of the primary mass, the secondary mass including at least one sloping surface oriented perpendicular to the front surface of the primary mass, the sloping surface having a lower end below an upper end;

resting a lower surface of the work piece adjacent the slope of the secondary mass;

closing the vise until the front surface of the primary mass abuts the work piece;

including the further steps of adapting the secondary mass and the primary mass to be removably attachable to each other;

selecting the secondary mass to have a sloping surface having an angle matching a desired angle for a surface of the work piece;

attaching the secondary mass selected in said selecting step to the primary mass; and closing the plates of the vise together until the front surface of the primary mass abuts the work piece; and removing the secondary mass from the primary mass, selecting a different secondary mass having a different sloping surface with a different angle matching a different desired angle for a surface of the work piece, attaching the different secondary mass to the primary mass, and closing the plates of the vise together until the front surface of the primary mass abuts the work piece.

23. A jaw for attachment to a vise having a fixed plate and a sliding plate with said sliding plate adapted to move toward and away from said fixed plate, the jaw comprising in combination:

a primary mass of rigid material having a substantially flat front surface;

a secondary mass adjacent to said front surface of said primary mass;

said secondary mass including at least one sloping surface, said at least one sloping surface oriented perpendicular to said front surface of said primary mass;

said sloping surface maintaining a fixed orientation relative to said primary mass;

at least one bolt hole passing substantially entirely through both said primary mass and said secondary mass, the bolt hole having a size at least as large as a diameter of a bolt adapted to be threaded into one of the plates of the vise, said bolt hole positioned to be aligned with at least one threaded bore in one of the plates of the vise; and at least one bolt oriented horizontally passing through said at least one bolt hole.

* * * * *